US007719415B2

(12) United States Patent
Dahl et al.

(10) Patent No.: US 7,719,415 B2
(45) Date of Patent: May 18, 2010

(54) ACCESS STATION FOR BUILDING MONITORING SYSTEMS

(76) Inventors: Andrew A. Dahl, 3280 Chickering La., Bloomfield Hills, MI (US) 48302; Edward V. Keiser, 1872 Hunters Ridge Dr., Bloomfield Hills, MI (US) 48304

( * ) Notice: Subject to any disclaimer, the term of this patent is extended or adjusted under 35 U.S.C. 154(b) by 223 days.

(21) Appl. No.: 11/978,553

(22) Filed: Oct. 29, 2007

(65) Prior Publication Data

US 2008/0129484 A1 Jun. 5, 2008

Related U.S. Application Data

(60) Provisional application No. 60/863,501, filed on Oct. 30, 2006.

(51) Int. Cl.
*G08B 25/00* (2006.01)

(52) U.S. Cl. ..... 340/525; 340/506; 340/521; 340/541; 361/680; 361/681; 361/687

(58) Field of Classification Search ..... 340/525, 340/506, 521, 524, 540, 541, 825.36, 825.49; 361/681, 687, 680; 348/143, 213
See application file for complete search history.

(56) References Cited

U.S. PATENT DOCUMENTS 4,831,438 A 5/1989 Bellman, Jr. et al.
4,962,473 A 10/1990 Crain
4,992,866 A * 2/1991 Morgan ..... 348/159
5,457,730 A 10/1995 Rounds
5,640,297 A 6/1997 Labaze
5,717,379 A 2/1998 Peters
6,281,790 B1 8/2001 Kimmel et al.
6,369,695 B1 4/2002 Horon
6,513,119 B1 * 1/2003 Wenzel ..... 726/2
6,628,510 B2 9/2003 Genin
6,972,676 B1 12/2005 Kimmel et al.
7,016,813 B2 3/2006 Alexander et al.
7,183,915 B2 * 2/2007 Bartholf et al. ..... 340/570
2002/0059246 A1 5/2002 Rowe
2003/0125998 A1 7/2003 McKenney et al.
2003/0202117 A1 10/2003 Garner

* cited by examiner

*Primary Examiner*—Hung T. Nguyen
(74) *Attorney, Agent, or Firm*—John R. Benefiel

(57) ABSTRACT

An external access station for interfacing with existing building monitoring systems to obtain data and control at least some of the systems for use by first responders to an emergency. The access station includes a protective enclosure recessed into a building exterior wall or adjacent kiosk housing a panel PC and touch screen display viewable upon opening a locked cover.

18 Claims, 8 Drawing Sheets

ACCESS STATION FOR BUILDING MONITORING SYSTEMS

CROSS REFERENCE TO RELATED APPLICATIONS

This application claims the benefit of U.S. provisional patent application Ser. No. 60/863,501, filed Oct. 30, 2006.

BACKGROUND OF THE INVENTION

This invention concerns electronic monitoring systems in buildings or groups of buildings such as a school campus. Most large commercial, government, residential and school buildings, particularly high rises, have electronically operated monitoring systems, such as closed circuit television systems (CCTV), burglar or intrusion alarm systems (BAS), access control systems (ACS), fire detection and notification systems, air handling systems, elevator control systems (ECS), and parking management systems (PMS). If an emergency occurs in the building, first responders must quickly gather accurate information about the building and the emergency situation.

It would also be desirable if the first responders could quickly gain access and perhaps control over at least some of the monitoring systems to the extent possible. While typically this would be possible from locations within the building by persons familiar with the location and the nature of the systems, the first responders typically would not have that familiarity and, more seriously, access to the building may be blocked or it may be too hazardous to enter.

Many emergencies have occurred in which an ineffective response has proved tragic. It has been proposed to interface with such building systems via the internet, but these have generally been incomplete and not easily accessible by first responders.

With respect to building security, the current state of the art in a security alarm annunciator is a simple panel, typically installed inside a building lobby, which displays a lit, blinking LED next to a floor or zone number when an alarm or sprinkler is activated. Faced with an array of floors or zones, emergency first responders, if they can even approach the building, are provided with only a blinking light to indicate that there may be a hostage situation, a medical emergency, a bomb or a fire.

A system has been offered commercially which is a touch screen LCD monitor installed inside the building, and offering information on the location of a fire, activated fire sensors and a rudimentary floorplan that is converted from CAD drawings that the building owner must supply. It is functionally no different than the blinking LED next to a floor or zone number on a typical panel.

In an overwhelming number of cases, emergency first responders have no idea what they are walking into, especially in a large public or office building. At the site of the Columbine High School tragedy, policy, firefighters and medical teams waited outside for hours, not knowing where the killers were located, how many were dead or injured, or the identity of the killers, even though the school had a camera and sensor system that was active and functional. Nor did they have floor plans for the school for at least 40 minutes after they first arrived.

If a fire alarm is tripped inside a large public or office building, fire crews will break down doors trying to find and encircle the affected area based on which smoke detectors were activated and displayed on a typical annunciator panel.

Insurers estimate that firefighters destroy 3 doors for every door necessary to be destroyed for fire control.

In some medical emergencies in high-rise buildings, first responders often arrive without the proper equipment and lose precious time backtracking, simply because they didn't know the extent or nature of injuries or because certain critical dimensions for elevators, stairwells or doorways prevent them from moving in the appropriate equipment.

It is the object of the present invention to provide an emergency interface with building monitoring and security systems which is easily accessed by first responders and provides a highly effective interaction with these systems.

SUMMARY OF THE INVENTION

The above recited object and other objects which will become apparent upon a reading of the following specification and claims are achieved by providing an externally located access station, i.e., from a location on a building exterior wall or a free standing kiosk adjacent to the building exterior. The access point includes a weatherized hardened panel PC with a touch screen monitor that is disposed in a protective enclosure recessed into an opening in the wall or kiosk structure and which is protected with a normally locked armored weatherproof cover. When the cover is opened with a key, a touch screen is exposed as well as a plurality of data ports. The panel PC may be extended from the enclosure to allow access to a CD/DVD player to allow updating or revisions to the panel PC.

The equipment at the access station includes a weatherized touch screen; a weatherized and hardened panel PC; a wireless transceiver; an uninterruptible power supply; an environmental control (HVAC); and a weatherized, bullet-resistant exterior enclosure.

The panel PC is interfaced to the building subsystems via programmable logic controllers.

The hardware and software at the access station provides a secondary monitoring capability, since it takes advantage of the existing building monitoring and control system already installed in the building, to be able to provide information and control available from the existing building systems and also may make the quickly available further information about the building without the need for a first responder to enter the building.

Once the bulletproof and weatherproof door is opened, the unit automatically starts up, and the large, ruggedized LCD touch screen displays any activated alarms, sprinklers or panic buttons, and other options available to the first responder. These activations are displayed in a map of the building or area. The fire or police professional can do any of the following:

1. Zoom into a detailed map of the emergency site;
2. Turn on and control any available CCTV cameras in the immediate area;
3. Revert to a previously stored set of images of the emergency site if power has been cut to the CCTV camera or they have been destroyed;
4. Place a measurement overlay on the previously stored images to determine distances, door or window opening sizes, hallway widths and heights, room dimensions and the like;
5. Monitor input from any networked security sensor or electromechanical safety device;
6. Disable or silence alarms or electromechanical devices;
7. Download any stored information from an internal security station to a laptop or storage device with the proper access password;

8. Use the device as an intercommunications protocol gateway, to distribute building information to cell phones, police radios, other emergency responders.

The first responder can also access other options, such as access overall ground plan, building plans, previously stored images of adjacent floors, rooms, halls, etc. and sequentially step through views of the entire building.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1A:
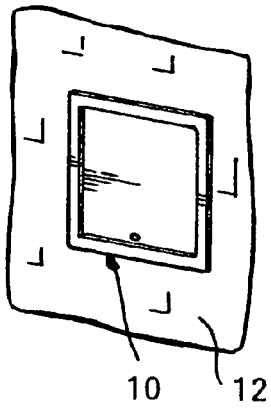
FIG. 1A-1C are pictorial views of an installed enclosure for the components at the access station of the three different operational conditions, shown installed in a building exterior wall shown in fragmentary form.
Figure 1B:
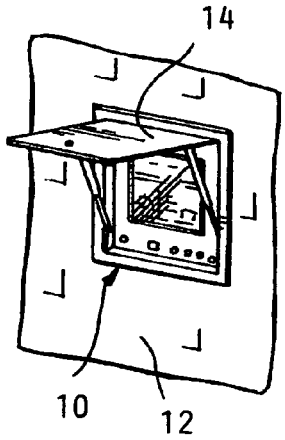
Figure 1C:
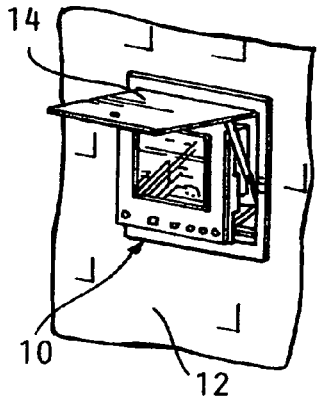
Figure 2:
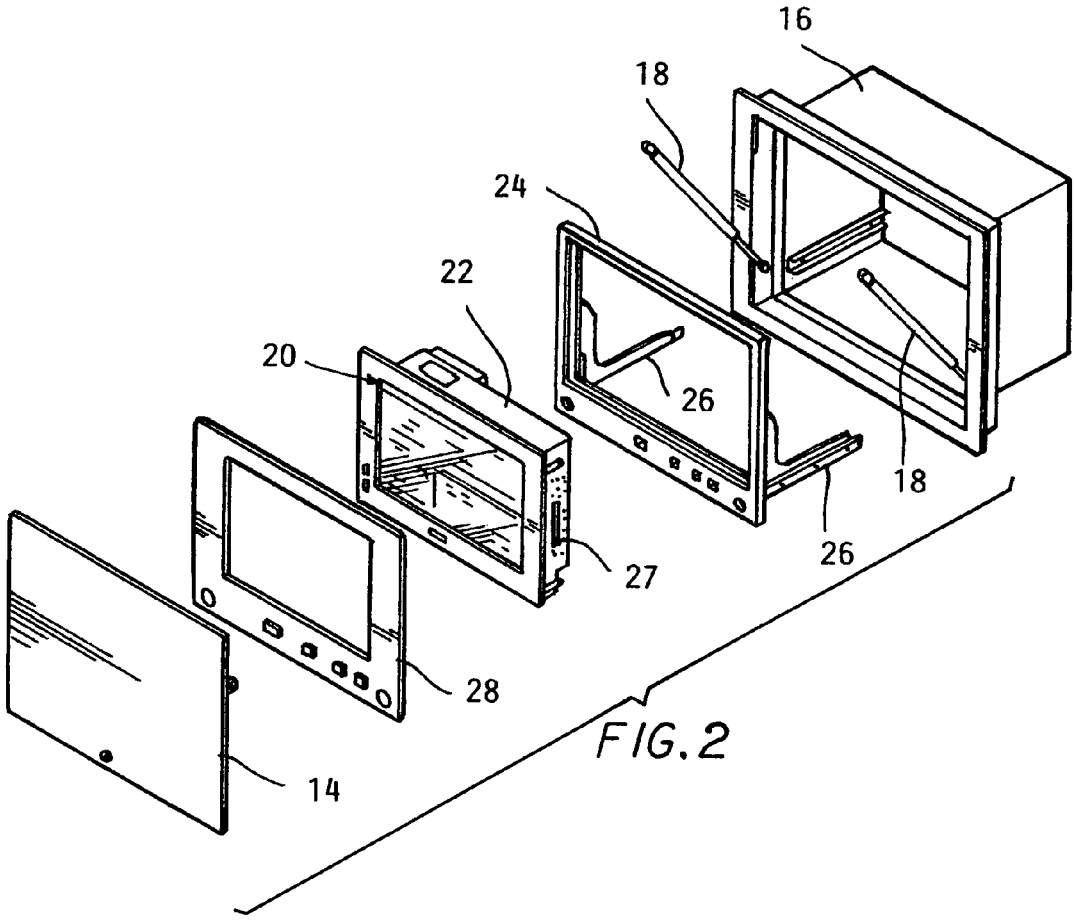
FIG. 2 is an exploded pictorial view of the major components of the access station according to the present invention.
Figure 2A:
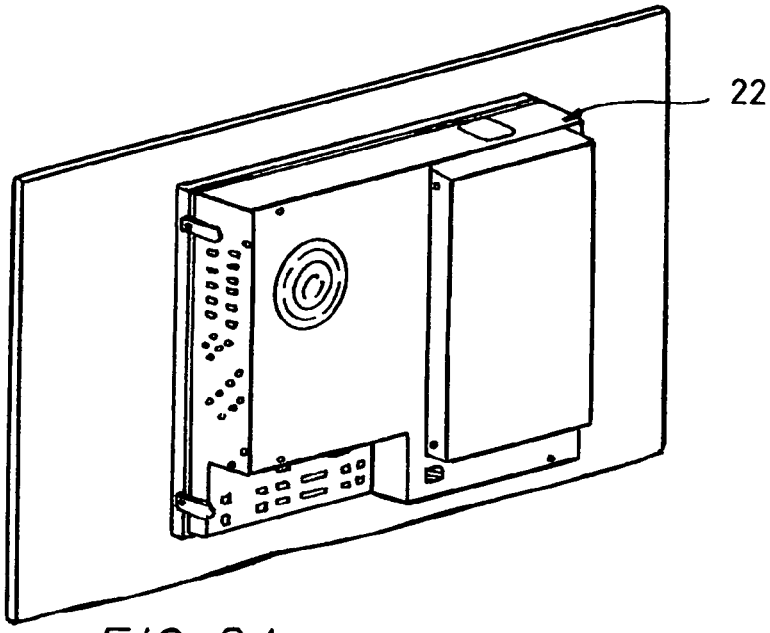
FIG. 2A is an enlarged pictorial view of a panel PC and support panel included in the access station shown in FIG. 2.
Figure 2B:
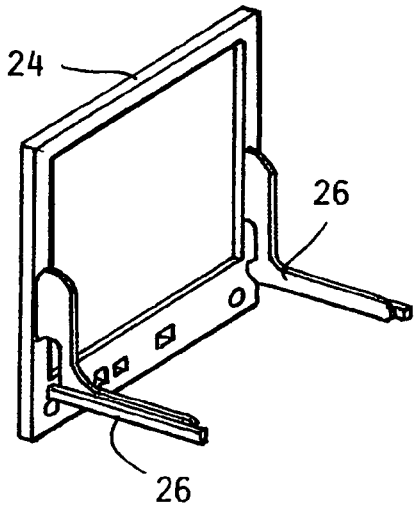
FIG. 2B is an enlarged rear pictorial view of a panel PC support frame and ball bearing slides.
Figure 2C:
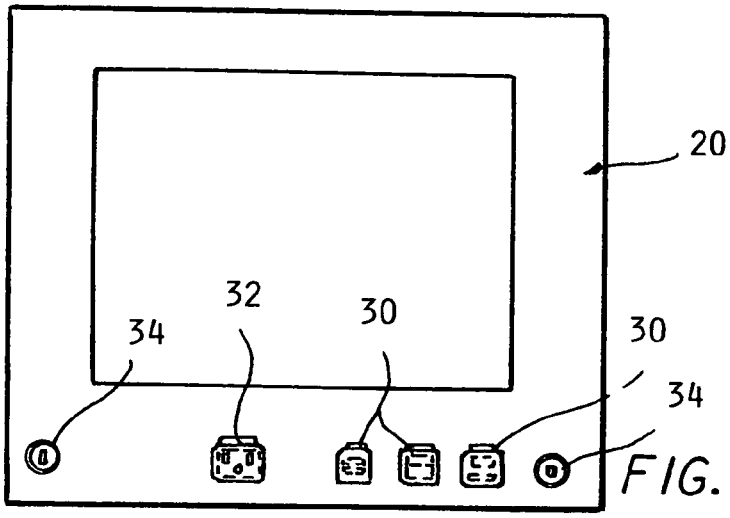
FIG. 2C is a front view of the touch screen and panel PC cover showing data ports and AC outlets.
Figure 3:
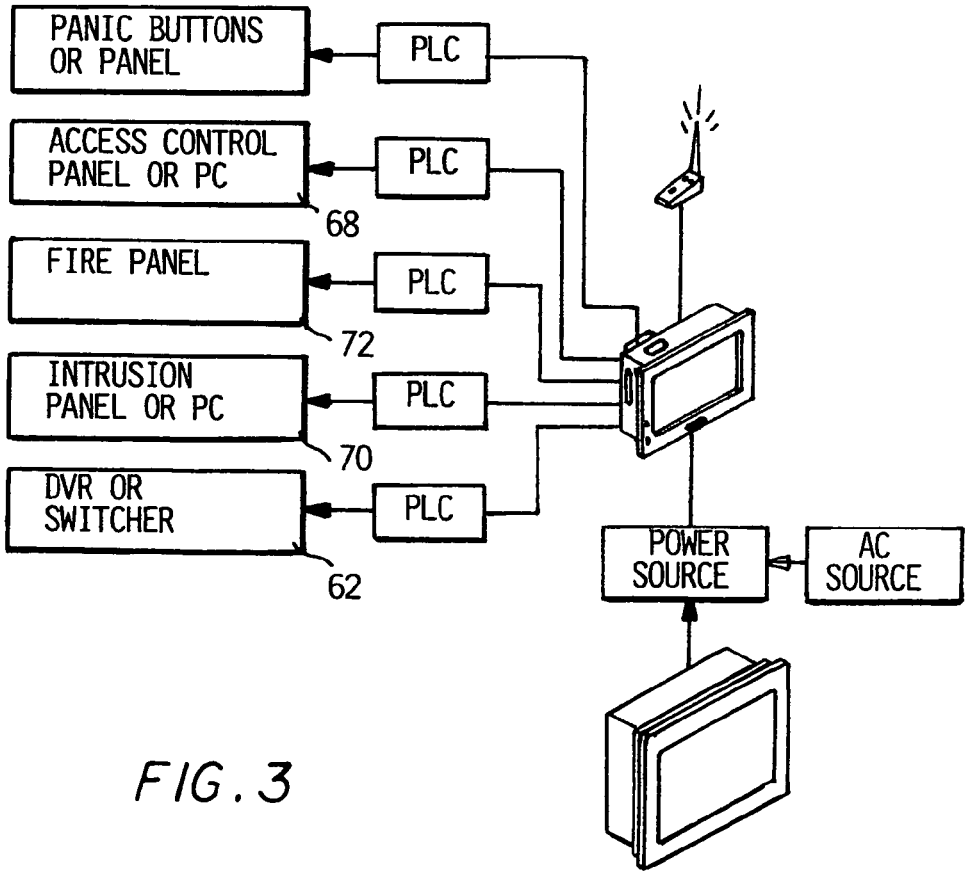
FIG. 3 is a pictorial diagram of the major hardware components included in the access station according to the present invention.
Figure 4:
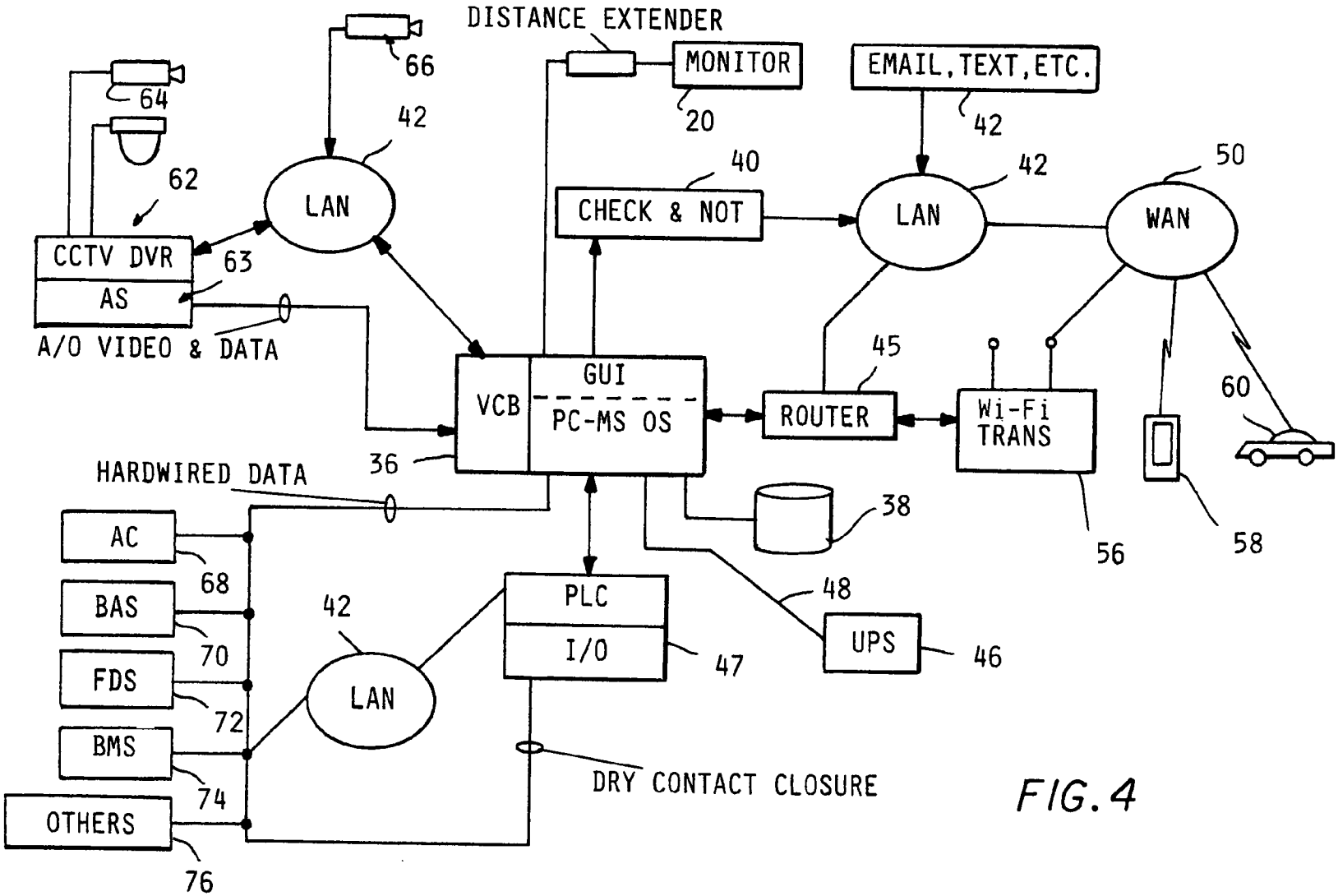
FIG. 4 is a software architectural diagram for the access station.

Referring to the drawings, a building systems access station according to the present invention includes an enclosure 10 recessed into an exterior wall 12 of a building (or of kiosk adjacent the building exterior). The enclosure 10 is of a depth to fit within the thickness of the building wall 12, and includes a bulletproof key locked cover 14 hinged at the top to a box enclosure 16 with one or more gas springs 18 supporting the cover 14 in a horizontal position when opened, as shown in FIG. 1B. This provides shade and weather protection for a touch screen monitor 20 mounted to a panel PC 22 supported on a mounting frame 24. The mounting frame 24 has slides 26 allowing the panel PC 22 to be advanced out as seen in FIG. 1C for servicing and access to a CD-DVD player slot 27.

A panel PC screen cover 28 has cutouts for data ports 30 and AC outlet 32 as well as key locks 34.

The panel PC 22 may be of a type available commercially and meeting military specifications for durability and a wide range of operating conditions.

The enclosure may be well insulated as necessary depending on local climate conditions to moderate the operating temperature range to be within specifications for the panel PC or alternatively heating and cooling devices may be provided such as thermoelectric devices. Panel PC's are available for military applications with very wide operating ranges although at greater cost.

Other preferable features include an LCD touch screen 20 utilizing acoustic wave technology so that gloved, wet, or greasy hands can still activate the screen. Heating and cooling elements can also be used with the touch screen as with the panel PC for providing tolerance for a wide range of operating conditions as necessary.

An armored clear polycarbonate screen shield for the LCD touch screen maybe provided along with NEMA 4 sealing.

A ballistic facia for the LCD touch screen and the interior of the enclosure 16 can also be optionally included, and the back of the enclosure 16 may also be armored.

The panel PC is loaded with software which provide the following capabilities:

1. The ability to control and/or poll a wide range of cameras, sensors, alarms, consoles, controllers and other security software included in the building systems through a hierarchical arrangement of specially written macro's and commands using the building systems manufacturers' own control protocols for each piece of equipment.

2. Provides first responders with intuitive, easy to use navigation and control buttons to quickly access information.

3. The ability to broadcast, via wireless 802.11 b,g and h standards, the same information and remote control capabilities to nearby laptops equipped with an encrypted receiver program specifically developed to communicate with the device.

4. The ability to tap into the building central control room via Ethernet cable, so as to make all information flowing into that central control room available to the access station. If the cable is disconnected or destroyed, the software program automatically switches to a wireless mode, with the sender unit located near the central control room.

5. The ability to retrieve recently recorded camera feeds stored in the central control room DVRs, if the control room is still functional.

6. The ability to create an archive of events after the central control room is destroyed, shut down or rendered inoperative, from any remaining or operating cameras or sensors.

7. In configuration/setup mode, the ability to accept CAD, dwg, dxf, jpg and other file formats to automatically create simple floor plans and navigable panoramic images.

8. In configuration/setup mode, the ability to locate or overlay camera, sensor, alarm and exit locations to floor plans.

9. In configuration/setup mode, the ability to input contact information, building specifications, electrical or mechanical control protocols.

In this way, emergency first responders can arrive on the scene, and without entering the building, access all of the security devices in that building. If those devices have been deactivated or rendered useless, first responders can access archived security or surveillance information stored at the access station, or the various plans, guides or related information about the building previously loaded into the PC memory which may aid them in their mission.

The touch screen display 20 is a color touch screen of flat panel type that is located in the security rated enclosure 16. In the static state where the system is operating blind without being monitored visually, it will display a standby status screen that allows authorized users to monitor access station system health, or to update information, or reconfigure the access station system for new components added to the existing security/CCTV system 62 which it monitors.

The touch screen display 20 is integrated into the panel PC (or a brick-type PC 22) located within the enclosure 16. The system functions via the Microsoft Windows—XP Pro Operating System, or the Vista Operating System platform. The system software is browser-based. Also within the CPU cage will be PCI mounted cards. There preferably is a minimum of one 4-input video digitizer and compression card, one Network Interface Card, one-4-input 2.0 USB card (collectively 36).

The data is stored via an onboard 320 GB hard drive 38 or greater capacity. The system may have mirrored or RAID Array storage. The data may also be stored on an owner provided Network Attached Storage (NAS).

The Health Check feature 40 connectivity is via the LAN/WAN 50 as this is a browser based system. Specific communication features such as e-mail, digital VM VOIP, text messaging, etc 44 is customer reliant. However, the means for that communication is an access station system function.

The CPU electrical power is protected by an isolated Power line conditioning Uninterruptible Power Supply (UPS) 46 with an isolated ground and battery back-up that is capable of operating this system for 3 hours. In the event the electrical, or emergency power does not come back on within 10 minutes, the UPS 46 automatically shuts down the system. However, when the power returned and is on for 3 minutes running, the system automatically reboot to operational status without any human intervention. The UPS 46 is connected to the CPU via a USB connection 48.

When the system is in operation under emergency or test mode, the LAN may be connected to the outside world via Wi-Fi network connectivity (802.11 b,g,h, and n) 50. The specific protocol may be changed with the industry improvements. This connectivity is interfaced with the WAN 50. This WAN 50 may itself be wireless and provide connectivity to mobile platforms 58, (Current Wireless Bands 802.11 b, g, h, and n). Typically, the connectivity from the CPU 22 to the LAN/WAN 50 is via a router 45.

In the event the existing LAN/WAN network connectivity 42 is not provided and DVR 54 are installed, the system connectivity is directed to the DVR 54 via a bus for control.

If the system is connected to the outside via the WAN 50 or WI-FI 56, the receiver locations 58, 60 may be bi-directional transceivers having full connectivity to the system and all attached sub-systems camera control 62, movable cameras 64, fixed cameras 60, access control 68, burglar alarm summary 70, fire detection summary 72, building management system 74. The system is configurable to prioritize any externally connected or internally connected components. Example: They may be view only, CCTV control only, or monitor any other connected system such as the Access Control and other systems such as public address system, elevator control, parking management, etc. Each attached device shall be fully configurable for varied administrative rights from All Access to Monitor only.

There are several sub-systems where bi-direction communication and control is a necessity, i.e., the closed circuit movable television system 64, Access Control 68, elevator control 76, digital video recording 63 and attached Programmable Logic Controllers 47. For these applications, control specific screens (not shown) should be provided with internal priority levels.

Figure 5M:
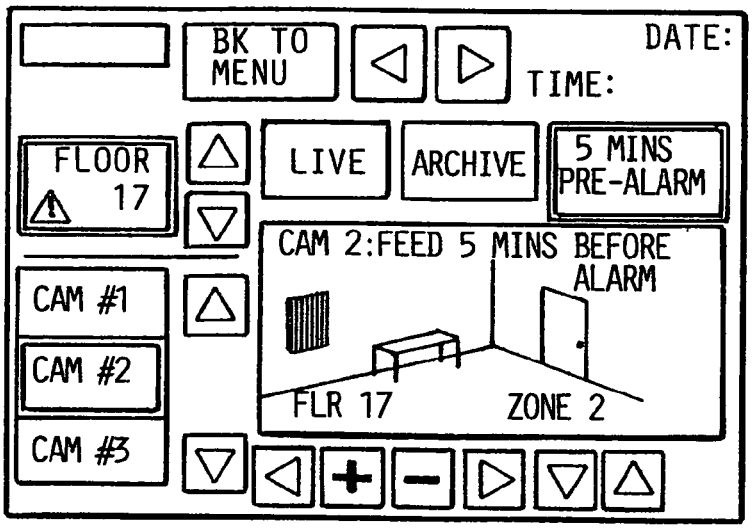
FIGS. 5A-5M are diagrams of the touch screen in different modes.
Figure 5A:
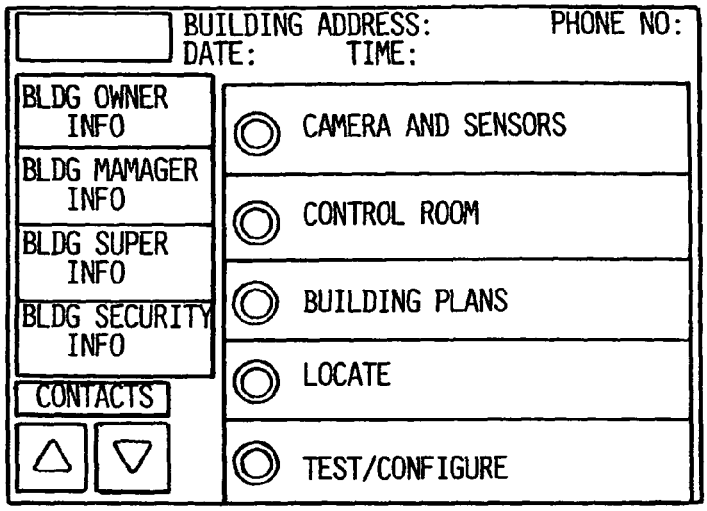
Figure 5B:
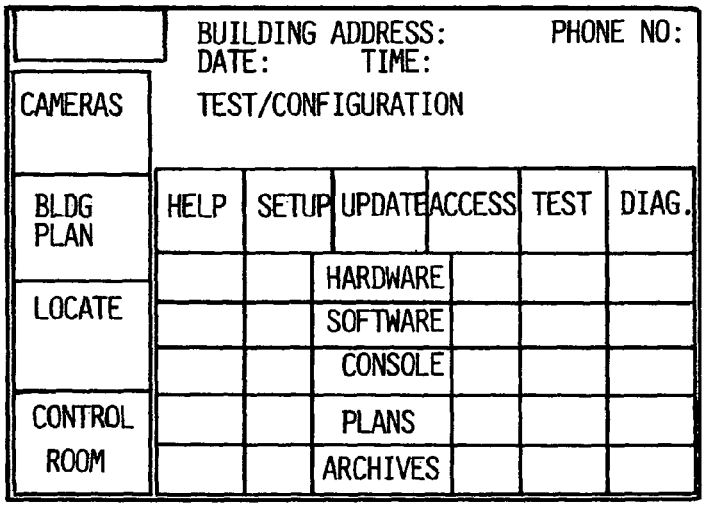
Figure 5C:
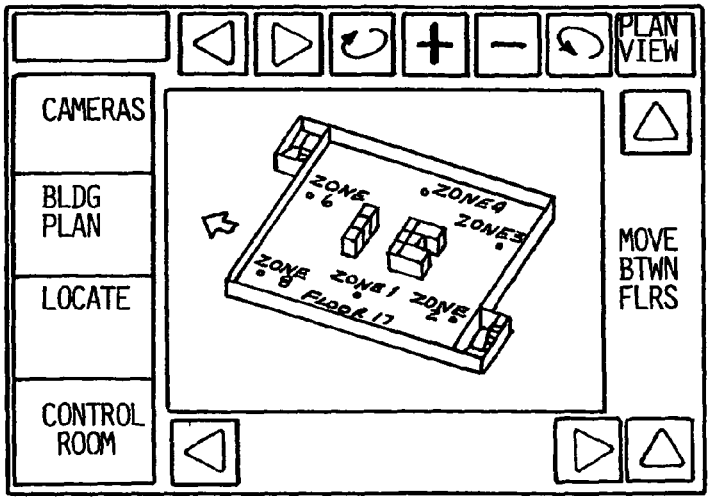
Figure 5D:
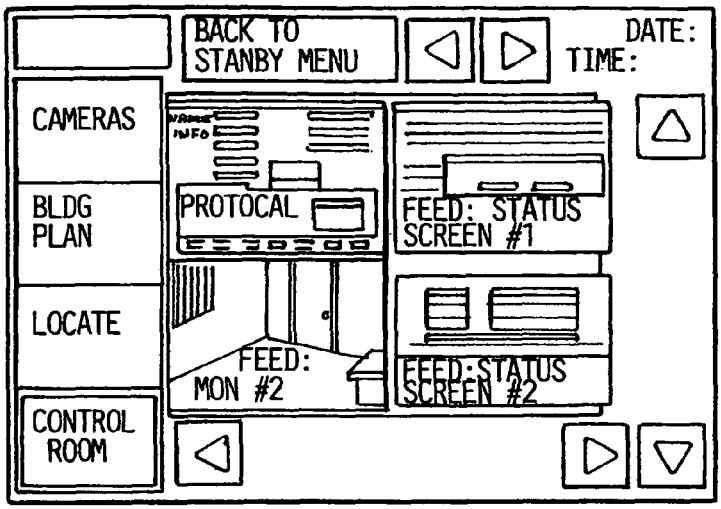

Various screen displays are shown in FIGS. 5A-5M. A standby screen is shown in FIG. 5A. The standby screen is displayed when the system is powered up or activated without an emergency activation. This can be to test, configure, install or otherwise maintain the access station. At the top of the screen form fields display the address/name of building and building phone number, the date/time field, and the owner of the access station system, with its serial number.

The logo button in upper left of the screen indicates the system health. If there are any deficiencies or failures, this logo flashes yellow.

Up to 10 contacts may be provided in scroll, any four of which are displayed including the title (building owner, manager, etc.), the physical address, the contact name, and the phone number. Contact scroll up/down buttons are located directly below contact scroll.

When 'Detail' button is touched on an individual contact button, the field for that individual button is highlighted and expanded to include a cell phone number, an e-mail, page, and additional information fields.

Figure 5E:
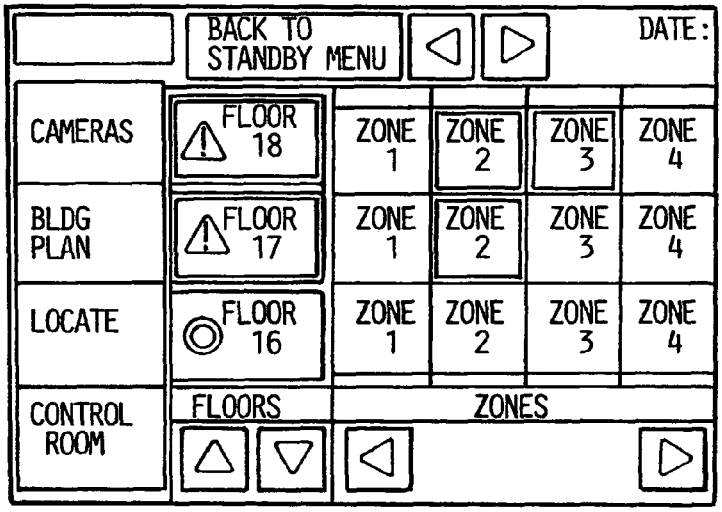
Figure 5F:
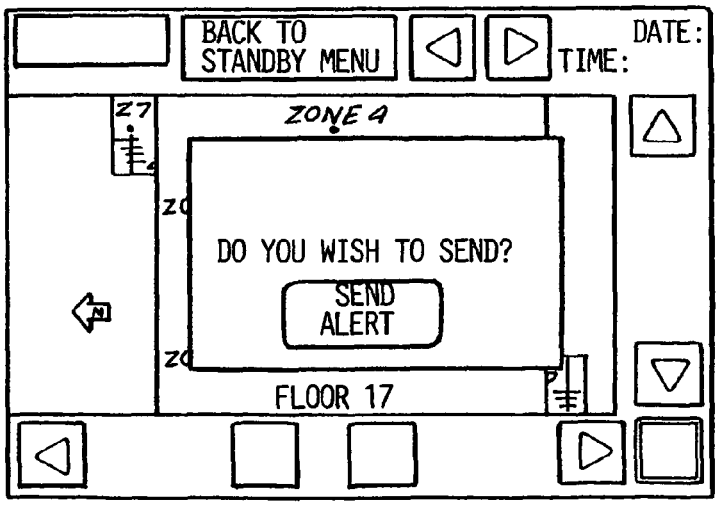
Figure 5G:
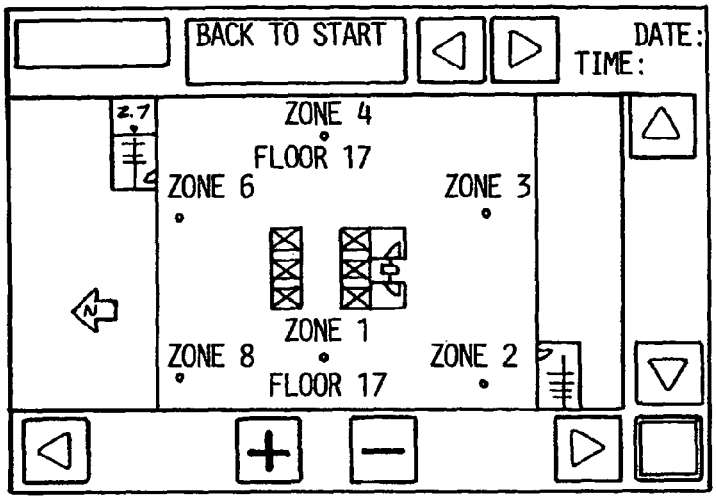

As seen in FIG. 5F, contact scroll up/down buttons are replaced by a 'Send Alert' button when 'Detail' for a particular contact is touched. Touching the Send Alert button will 1) activate internal wireless transceiver, 2) Send Alert is highlighted for 2 seconds, 3) after 2 seconds, Send Alert button is replaced by up/down arrows, and 4) after 2 seconds, expanded contact field reverts to standby mode.

Touching five (5) large status buttons A, B, C, D, E allow an authorized installer, maintenance person or end-user to check the status of all connections and systems tied to the system.

Touching button A causes the Camera screen (screen shot shown in FIGS. 5K-5L) to appear. User now has the ability to navigate that screen.

Touching button B causes Control Room screen (screen shot shown in FIG. 5D) to appear.

Touching button C causes Building Plan screen (screen shot shown in FIG. 5J) to appear.

Touching button D causes Locate screen (screen shot shown in FIG. 5C) to appear.

Touching button E causes Test/Configure screen (screen shot shown in FIG. 5B) to appear.

Figure 5H:
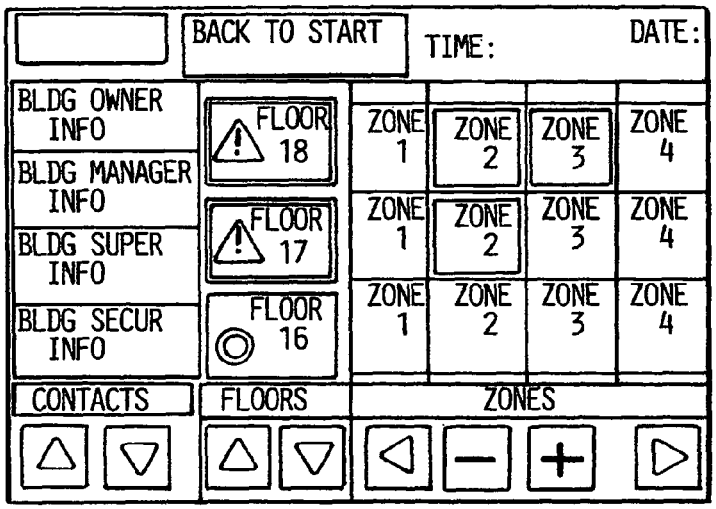
Figure 5I:
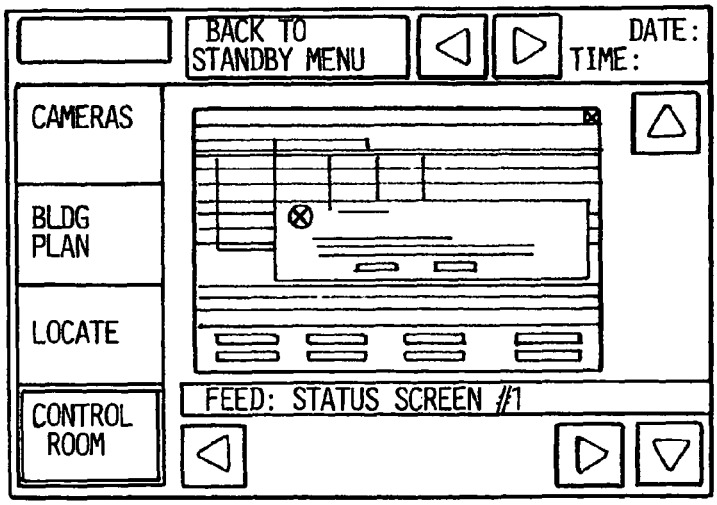
Figure 5J:
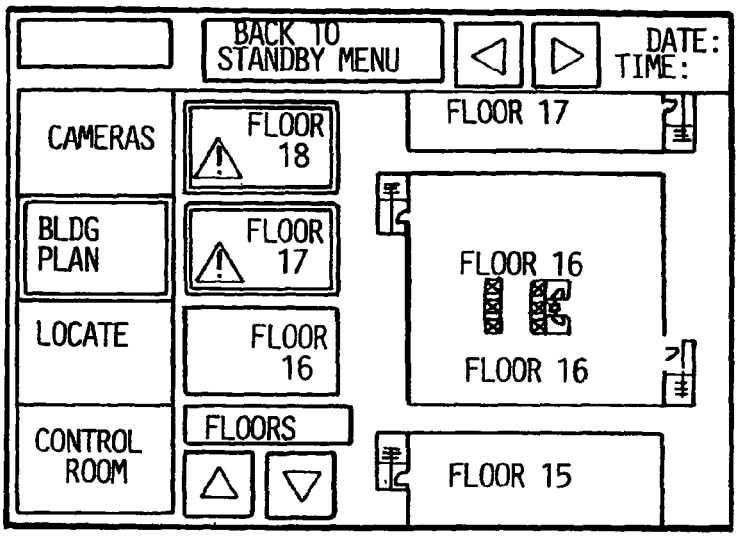
Figure 5K:
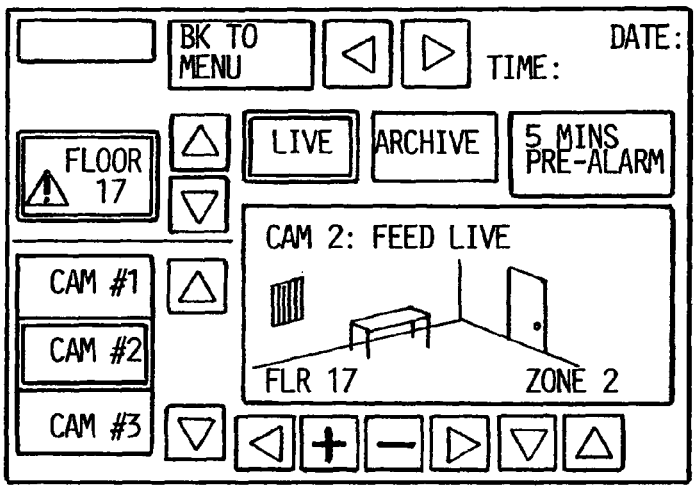
Figure 5L:
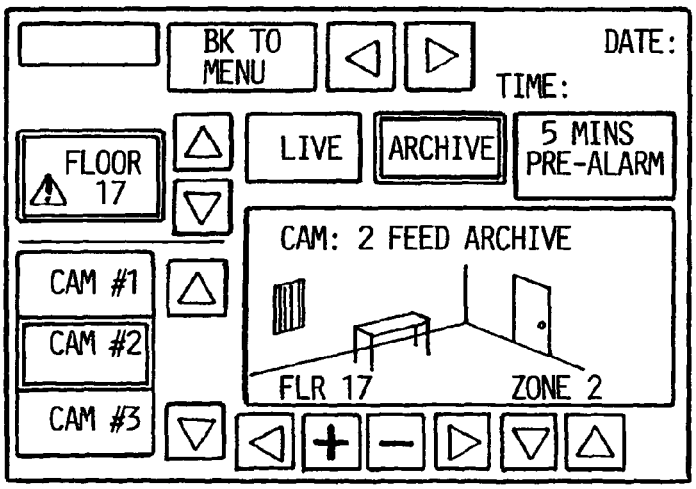

The Alert Screen as shown in FIG. 5H is displayed upon activation of any alarms, sensors, or panic buttons tied to the unit. This is the starting screen used by fire, police or EMT when the protective door is first opened.

At the top of the screen, the address/name of building, phone number and ownership fields are replaced with a "Back to Start" button and two back/fwd buttons. These buttons allow the user to move backward or forward one screen at a time, displaying their previous choices. Time/date of alarm activation replaces time/date field from Standby Screen (screen shot shown in FIG. 5A).

The contacts scroll is carried over from Standby Screen (screen shot shown in FIG. 5A), with the same function Logo Button carried over from Standby Screen with the same function.

A floor scroll is added with up to 100 floors in scroll, of which 4-5 are displayed at any one time. When a sensor or alarm is activated on a particular floor, that floor is displayed in the scroll window, and is red. If more than one floor is alarmed, the display will show the first floor on which an alarm or sensor was activated. The scroll moves vertically.

The Floor scroll buttons are located directly below Floor Scroll window. Up/down buttons move the scroll. If there are activated alarms on floors below the floors shown in the Floor Scroll window, such as those alarmed later, the Down button will flash. If there are activated alarms on floors above the floors shown in the Floor Scroll window, the Up button will flash. If there are activated alarms on both floors above and below the floors shown, both Up and Down buttons will flash continuously.

A zone scroll allows up to 50 zones per floor, of which 4 are displayed at any one time. When a sensor or alarm is activated in a particular zone, that zone is displayed in the scroll window and is red. If more than one zone is alarmed, the display will show the first zone activated, and display other zones if they are within the window. The scroll moves horizontally.

Zone scroll buttons are located directly below zone scroll window. Left/right buttons move the scroll in the window. If there are activated alarms in zones numbered higher than zones displayed, the right scroll button will flash. If there are activated alarms in zones numbered lower than zones displayed, the left scroll button will flash. If there are activated alarms in zones higher or lower than those displayed, both buttons will flash.

Also included are +/−buttons located between the left and right zone scroll buttons. This allows the user to momentarily change the scale of the scroll, allowing up to 20 zones to be displayed per floor in the same window. The "+" button scales up, and times out after 4 seconds. The "−" button returns the scale-up to the original 4 zones per floor.

When the alert screen of FIG. 5E is up, a semi-transparent graphic "TOUCH HERE TO START" will flash for ½ second every 3 seconds in the area displaying the floor scroll and zone scroll.

A start screen (screen shot shown in FIG. 5E) is displayed upon touching the alert screen anywhere in the area of the floor scroll or zone scroll, as prompted by the flashing "Touch here to start" graphic overlay.

The top of the screen is carried over from alert screen (screen shot shown in FIG. 5H) but adding two buttons, forward and backward, to allow user to step back or forward of previous choices.

A vertical series of access buttons replace the contact scroll in the standby and alert screens.

The cameras causes camera screen (screen shot shown in FIG. 5K) to appear and activate.

The building plan access button causes building plan screen (screen shot shown in FIG. 5J) to appear and activate.

The locate access button causes locate screen (screen shot shown in FIG. 5C) to appear and activate.

The control room access button causes control room screen (screen shot shown in FIG. 5D) to appear and activate.

The logo button is carried over from the standby screen with the same function.

The floor scroll and floor scroll buttons are carried over from alert screen (screen shot shown in FIG. 5H).

Zone scroll and zone scroll buttons are carried over from the alert screen.

The locate screen is displayed after touching the "locate" button on the start screen (screen shot shown in FIG. 5C), after which the "locate" button remains highlighted on the locate screen.

The top of screen is carried over from the start screen with rotate clockwise, zoom in, zoom out, rotate counterclockwise and plan view buttons.

The logo button is carried over from the standby screen (screen shot shown in FIG. 5A).

The access buttons are also carried over from the start screen, "locate" button would remain highlighted when locate screen is displayed.

The locate window replaces the floor scroll, floor scroll buttons, zone scroll and zone scroll buttons from start screen. This window displays 3D or 2D custom content (not core application) developed specifically for each end-user. Content may consist of simple 3D or 2D model that responds to axis controls resident in the core application and activated by the window buttons.

The 3D or 2D content that is loaded into the base application, usually in the form of floor plans, may contain icons for zone locations and/or camera positions. These icons have 'flags' or 'hooks' to allow the core application to communicate which zones have been alarmed, using the same communications protocol as in the start screen scrolls, which highlight alarmed floors and zones. The small zone icons will be highlighted if alarms or sensors have been activated in that area.

The camera position icons, when touched, opens up an overlay window which presents a static, archived view from that camera position. If the end-user wants to see a live version of that camera and its view, they merely touch the "cameras" access button and the application 'remembers' the camera, its zone and floor, so that when the "cameras" screen opens, that camera view is displayed in the window.

Arrow keys below the locate window allow scrolling left to right if the 3D/2D image is too large to fit within the widow. Up/down keys allow for vertical movement between floor images. Rotate and zoom buttons may be located between the horizontal left to right keys below the locate window. Plan view button is to be located between up and down keys.

The invention claimed is:

1. A secondary monitoring access station system for a building having one or more primary monitoring systems comprising:

a weatherproof enclosure on an exterior structure associated with said building and including a lockable cover openable by a person located outside but adjacent to said building;

a monitor screen in said enclosure, exposed to be viewable upon opening of said cover; and a computer in said enclosure operatively connected to said monitor and to at least one of said building monitoring systems to selectively display of information available from said building monitoring systems on said monitor in said enclosure.

2. The access station system according to claim 1 wherein said monitor is an acoustic wave LCD touch screen device allowing activation by gloved, wet or greasy hands enabling inputs into said computer to control display of said information from said building primary monitoring system.

3. The access station system according to claim 2 wherein said building monitoring systems includes a plurality of surveillance video cameras and recorders and said computer is programmed to selectively display video data from said cameras.

4. The access station system according to claim 3 wherein said building video system includes control of one or more of said cameras and wherein said computer is programmed to also be able to control said one or more video cameras.

5. The access station system according to claim 4 wherein said building video system includes accessible archived video data record and wherein said computer is programmed to also access said archived video data and display the same on said monitor.

6. The access station system according to claim 2 further including a memory associated with said computer having building data stored thereon and able to be selectively displayed in said touch screen display.

7. The access station system according to claim 6 wherein said building data includes building floor plans.

8. The access station system according to claim 1 wherein said building structure comprises an external exterior wall of said building, and said enclosure is recessed into the outside of said exterior wall.

9. The access station system according to claim 2 wherein a plurality of said building monitoring systems are accessible by said computer and data therefrom is able to be displayed on said touch screen monitor.

10. The access station system according to claim 9 wherein said building monitoring systems include fire detection and intrusion detection.

11. The access station system according to claim 9 wherein a PLC is associated with each of said building monitoring systems and said computer to enable addressing said monitoring systems.

12. The access station system according to claim 1 wherein said enclosure including said cover is hardened against ballistic penetration.

13. The access station system according to claim 1 further including a wireless connection between said computer and said building monitoring systems.

14. The access station system according to claim 3 wherein said building is a high rise having many floors and areas on each floor selectively viewable on said monitor screen by access to said building security system.

15. The access station according to claim 12 wherein a ballistic penetration shield covers said monitor screen.

16. The access station system according to claim 1 wherein said enclosure is insulated.

17. The access station system according to claim 1 wherein said enclosure is heated.

18. The access station system according to claim 1 wherein said enclosure is cooled.

* * * * *